219-121 SR
3/30/76 XR 3,947,801

United States Patent [19]
Bube

[11] 3,947,801
[45] Mar. 30, 1976

[54] LASER-TRIMMED RESISTOR

[75] Inventor: Kenneth Roger Bube, Skillman, N.J.

[73] Assignee: RCA Corporation, New York, N.Y.

[22] Filed: Jan. 23, 1975

[21] Appl. No.: 543,622

[52] U.S. Cl. ..... 338/308; 29/620; 219/121 LM; 338/309
[51] Int. Cl.[2] ..... H01C 1/012
[58] Field of Search ..... 338/308, 309, 195; 219/121 LM; 29/620

[56] References Cited
UNITED STATES PATENTS 2,597,674 5/1952 Robbins ..... 338/195 X
3,573,703 4/1971 Burks ..... 338/309

*Primary Examiner*—E. A. Goldberg
*Attorney, Agent, or Firm*—Glenn H. Bruestle; Donald S. Cohen

[57] ABSTRACT

A laser-trimmed film resistor wherein the laser kerf terminates in an area outside the electrical current path across the resistor.

6 Claims, 4 Drawing Figures

LASER-TRIMMED RESISTOR

FIELD OF THE INVENTION

This invention relates to film resistors. More particularly, this invention relates to laser-trimmed thin and thick film resistors containing a laser kerf which terminates outside the electrical current path across the resistor.

BACKGROUND OF THE INVENTION

Film resistors are commonly used in hybrid circuits and include thick film resistors which are conventionally formed by screen-printing a resistive material on an insulating substrate and then firing the material, and thin film resistors which are conventionally formed by sputtering or vacuum-depositing a resistive material on an insulating substrate.

In hybrid circuits it is often necessary to adjust the resistance of the film resistors in the circuit. To increase the resistance of a film resistor the resistor is "trimmed" by forming a kerf, i.e., a cut or ditch, across the electrical current path in the resistor to make the effective width of the resistor smaller and thereby increase the resistance. The kerf may be formed by mechanical abrasion, chemical etching, or laser vaporization of the resistor material. The advantages of laser-trimming over mechanical- or chemical-trimming include very high production rates, greater flexibility in functional trimming, and tighter tolerances.

The greatest disadvantage of laser-trimmed resistors with conventional kerf configurations (which will be described hereinafter) is that they exhibit appreciably greater drift, i.e., change in resistance per unit time or temperature, than mechanically- or chemically-trimmed resistors. Consequently, the inherent advantages of laser-trimming can be outweighed by the undesirable drift characteristics of the laser-trimmed resistor. Therefore, it is important to develop laser-trimmed resistors with low resistor drift.

SUMMARY OF THE INVENTION

I have discovered that directing the terminus of a laser kerf in a laser-trimmed film resistor into an area outside the electrical current path across the resistor results in less resistor drift.

DETAILED DESCRIPTION OF THE INVENTION

Figure 1:
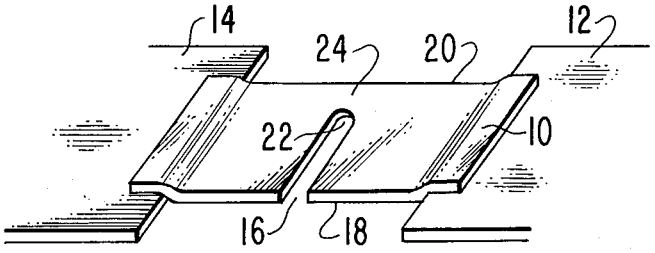
PRIOR ART Fig. 1.
FIG. 1 is an elevated view of a film resistor with a "plunge cut" laser kerf found in the prior art.

Referring now to FIG. 1, a conventional laser-trimmed resistor is made by depositing a film 10 of a resistive material, e.g., a carbon, metal, or cermet film, on an insulating substrate (not shown), e.g., an alumina substrate, between two conductive means 12 and 14, e.g., conductive metal films of gold, copper, and the like. A kerf 16 is vaporized in the resistive film 10 with a laser beam (not shown). The kerf 16 starts on one side 18 of the resistive film 10, extends substantially perpendicular to the electrical current path between the conductive means 12 and 14, and terminates in the resistive film 10 at a terminus 22, i.e., a terminal crater. This type of kerf 16 is referred to as a plunge cut. The terminus 22 of the kerf 16 defines an area 24 for the electrical current path across the resistive film 10. By narrowing the width of the electrical current path, the kerf 16 increases resistance of the film 10. The terminus 22 of the kerf 16 of a plunge cut is defined as being "inside" the electrical current path across the resistive film 10. By "inside" it is meant the terminus 22, i.e., the terminal crater, of the laser kerf 16 is directly adjacent to, contiguous with, or bordering on the electrical path defined in the resistive film 10 by the kerf 16.

Figure 2:
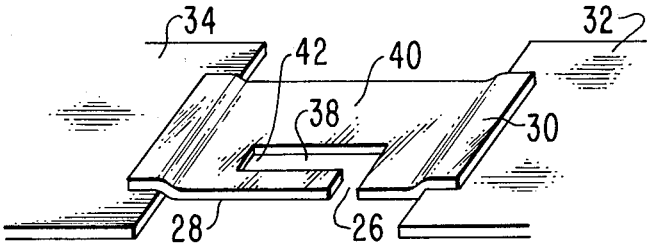
PRIOR ART Fig. 2.
FIG. 2 is an elevated view of a film resistor with an "L cut" laser kerf found in the prior art.

FIG. 2 illustrates a second conventional laser-trimmed resistor found in the prior art. Referring now to FIG. 2, a kerf 26 is vaporized in a resistive film 30 with a laser beam (not shown). The kerf 26 starts on one side 28 of the resistive film 30, extends perpendicular to the electrical current path between two conductive means 32 and 34, then reflexes parallel to the electrical current path, and terminates in the reflexed portion 38 of the kerf 26. This type of kerf 26 is referred to as an L cut and is used for precise adjustment of the area 40 for the electrical current path and, thereby, precisely adjusts the resistance of the resistor. Again, the terminus 42 of the kerf 26 is defined as being inside the electrical current path across the resistive film 30, i.e., the terminus 42 is abutting the electrical current path.

Figure 3:
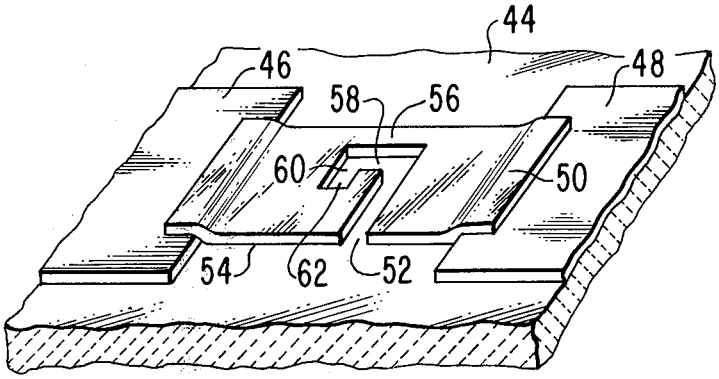
FIG. 3 is an elevated view of a film resistor on an insulating substrate illustrating one embodiment of the present invention.
Figure 4:
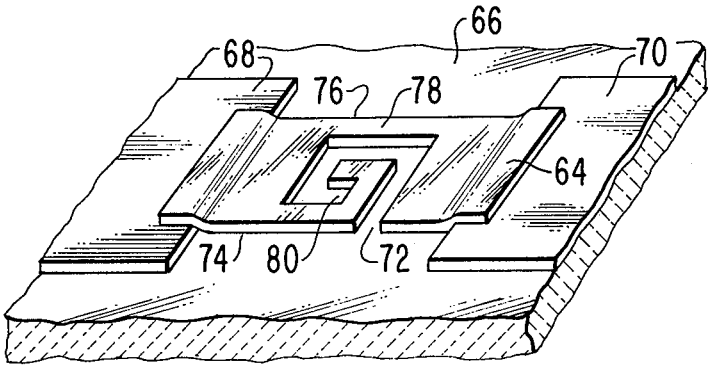
FIG. 4 is an elevated view of a film resistor on an insulating substrate illustrating another embodiment of the present invention.

FIGS. 3 and 4 illustrate embodiments of the present invention. However, it is understood that the present invention is not limited to these two specific embodiments.

Referring now to FIG. 3, a resistive paste is screen-printed onto an insulating substrate 44, e.g., an alumina substrate, between two conductive means 46 and 48, e.g., conductive metal films of gold, copper, and the like. A resistive paste is a complex mixture of glass, metal, and semiconductive oxide particles suspended in an organic vehicle containing solvents, surfactants, and flow control agents. The resistive paste is then fired to form a resistive film 50 between the conductive means 46 and 48. Firing temperatures for typical resistor pastes are from 800°C to 900°C for 6 to 12 minutes. Alternatively, the resistive film 50 may be deposited by other techniques well-known to those skilled in the art, e.g., evaporating or sputtering.

A kerf 52 is formed by vaporizing material from the resistive film 50 with a laser beam. The kerf is started at one side 54 of the resistive film 50 not connected to the conductive means 46 and 48 and is extended substantially perpendicular to the electrical current path across the resistive film 50. The kerf 52 is continued until an area 56 which defines a desired current path across the resistive film 50 is delineated in the resistive film 50. Then the kerf 52 is reflexed substantially parallel to the electrical current path in the resistive film 50 for a short distance 58. Finally, the kerf 52 is reflexed substantially perpendicular to and away from the electrical current path for a short distance 60. The kerf 52 is terminated in a terminus 62, i.e., a terminal laser crater, in the last reflexed portion 60 of the kerf 52. The final reflexed portion 60 of the laser kerf 52 may be in any direction away from the electrical current path so long as the terminus 62 of the kerf 52 is "outside" the electrical current path defined by the kerf 52 and may extend any desired distance in the resistive film 50. If desired, the final portion 60 of the laser kerf 52 may extend to the side 54 of the resistive film 50 where the kerf 52 originated, forming a "loop" in the resistive film 50. Again, the terminuss of the kerf would be "outside" the electrical current path across the resistive film, i.e., not abutting or contiguous with the electrical current path.

A laser kerf of the configuration shown in FIG. 3 is termed a "plunge-hook." It is understood that a plurality of plunge-hook kerfs may be formed in the resistive film and that the kerfs may extend from either or both of the sides of the resistive film not connected to the conductive means.

FIG. 4 illustrates another embodiment of the present invention. Referring now to FIG. 4, a kerf 72 is formed in a resistive film 64 deposited on an insulating substrate 66 between two conductive means 68 and 70. The kerf 72 is started on a side 74 of the resistive film 64, extended substantially perpendicular to the electrical current path across the resistive film 64, reflexed substantially parallel to the electrical current path to precisely define an area 78 for the electrical current path, then reflexed substantially perpendicular to and away from the electrical current path, and finally the kerf 72 is terminated in a terminus 80 in a reflex parallel to the electrical current path and toward the first portion of the kerf 72. A kerf of the configuration shown in FIG. 4 is termed an "L-hook cut". The terminus of the L-hook cut lies outside the electrical current path defined by the kerf 72.

Laser-trimmed resistors employing the kerf configurations of the present invention, i.e., hook-cut kerfs, exhibit a marked improvement in stability, i.e., a marked decrease in resistor drift. To illustrate this improvement tests were performed comparing the drift characteristics of resistors with conventional kerfs to the drift characteristics of resistors with hook cut kerfs.

In order to compare the laser-trimmed resistors with conventional kerfs to those with hook cut kerfs a standard test pattern was selected which contained 0.100 inches × 0.100 inches (0.254cm × 0.254cm) film resistors. The resistors were formed from films of DuPont series 1400 1 × $10^6\Omega$/square resistor paste, available from DuPont Electronic Products Division, Niagara Falls, N.Y., screen-printed with a 200 mesh screen on a standard 1 inch × 1 inch × 0.025 inches (2.54cm × 2.54cm × 0.063cm) 614 (96%$Al_2O_3$) substrate, available from American Lava Corporation, Chattanooga, Tenn. The screen-printed resistor paste had an emulsion thickness of about 0.7 mil ($1.8 \times 10^{-3}$cm) and was fired at about 850°C for about 6–12 minutes.

A plunge-cut kerf measuring about 0.09 inches (0.23cm) long was formed in one resistor. A plunge-hook cut kerf was formed in a second resistor. The first portion of the plunge-hook cut kerf, perpendicular to the electrical current path, measured about 0.09 inches (0.23cm) long. The portion of the kerf parallel to the electrical current path was about 0.005 inches (0.0127cm) long, and the final hook portion of the kerf was about 0.020 inches (0.051cm) long. The control resistor was an untrimmed-resistor formed in a manner identical to the trimmed-resistors described above.

The kerfs were formed in the resistive films using a Teradyne W-311 laser trimmer, available from Teradyne, Inc., Chicago, Ill. The laser parameters were:

| | |
|---|---|
| Linear energy density | = 1 joule/cm |
| Repetition rate | = 1 KHz |
| Trim Speed | = 0.254 cm/sec. |
| Bite Size | = 2 (0.1 mil/pulse) |
| Kerf Width | = about 20 μm |

The electrical resistance of the resistors was measured with a Teradyne bridge, which is part of the trimmer, immediately before and after trimming, within 1 second after trimming, 5 seconds after trimming, and more than one week after trimming. After one week the resistor has stabilized at its final resistance.

A second series of resistors were produced according to the process described above. The resistance of these resistors was measured 5 seconds after trimming. Then these resistors were exposed to 5 cycles of a thermal shock treatment. The thermal shock treatment is used to determine resistor stability and involves raising the temperature of the resistor surface from room temperature to approximately 400°C in 300 msec. (1200°C/sec. heating rate) by exposing the resistor to a heated air blast. After each heated air blast the samples were immersed in deionized water at 22°C. The thermal shock treatment closely simulates actual thermal excursions in normal production environments. These thermal excursions include exposures to hot stages for chip-bonding and solder reflow steps. In addition, in certain applications, resistors are exposed to electrical current surges which cause rapid temperature increases. The final resistance of the shocked resistors was measured more than one week after the shock treatment.

Because of film thickness variations in each resistor the actual lengths of the portion of the kerfs perpendicular to the current paths varied. Consequently, direct comparison of the resistance drift of each resistor to that of another resistor is not meaningful. Previous experience has shown that resistors which show the least drift at the shortest distance from the untrimmed edge are the most stable. From this experience a Figure of Merit (FOM), i.e., an arbitrary internal comparison scale, was derived to compare the relative stability of the resistors. The Figure of Merit used in this analysis is $$\text{Figure of Merit (FOM)} = (1000/\%\ \Delta R \times \text{distance from the untrimmed edge of the resistor in } \mu m)$$

The higher the Figure of Merit the more stable the resistor.

The following table gives the results of the measurements described above.

| | Control | Plunge | | Hook | |
|---|---|---|---|---|---|
| | | Unshocked | Shocked | Unshocked | Shocked |
| Distance to Untrimmed Edge (μm) | — | 376 | 352 | 360 | 378 |
| $R_i$ | 0.77MΩ | 2.362MΩ | 2.424MΩ | 2.503MΩ | 2.411MΩ |
| $R_f$ | 0.772MΩ | 2.368MΩ | 2.431MΩ | 2.511MΩ | 2.415MΩ |
| %ΔR | 0.28 | 0.25 | 0.30 | 0.16 | 0.17 |
| Ratio | — | 2.92 | 2.96 | 3.18 | 3.16 |

-continued

| | Control | Plunge | | Hook | |
|---|---|---|---|---|---|
| | | Unshocked | Shocked | Unshocked | Shocked |
| Figure of Merit | — | 10.6 | 9.5 | 17.4 | 15.6 |

In this table
$R_i$ = the resistance 5 seconds after trim;
$R_f$ = the final resistance (the resistance more than one week after processing);
$\% \Delta R = [(R_f - R_i)/R_i] \times 100$; and
Ratio = the ratio of the resistance immediately after trimming to the resistance immediately before trimming.

The data presented above shows that resistors with a hook-cut kerf are more stable than resistors with a conventional plunge cut kerf.

Resistors with hook cut, plunge cut, and L cut kerfs were formed from different resistor pastes. The L cut kerfs were about 0.09 inches (0.23cm) long perpendicular to the current path and about 0.040 inches (0.1cm) long parallel to the current path. The dimensions for both the plunge cut and hook cut resistors were nearly identical to those described above. The laser parameters were identical to those described above.

While direct comparisons between plunge cut, hook cut and L cut kerfs in resistors formed from the same paste often showed discrepant results, an overall statistical improvement in the resistor drift was shown for both hook cut and L cut resistors when compared with plunge cut resistors. The formulas for determining this improvement were (Hook FOM-Plunge FOM) 100 ÷ Plunge FOM for "hook cuts"

and (L FOM-Plunge FOM) 100 ÷ Plunge FOM for "L cuts".

The improvement of the unshocked and shocked L cuts over the unshocked and shocked plunge cuts was 1.9 and 23.9 percent, respectively. The improvement of the unshocked and shocked hook cuts over the unshocked and shocked plunge cuts was 38.5 and 63.0 percent, respectively.

I claim:

1. A film resistor comprising a resistive material disposed between conductive means, said resistive material containing one or more kerfs defining the path for an electrical current in said resistive material, said kerf having one end at an edge of the resistive material and a second end terminating in an area outside and away from said electrical current path.

2. A resistor according to claim 1 wherein said kerf originates on a side of said resistor substantially parallel to said electrical current path, extends substantially perpendicular to said electrical current path, reflexes substantially parallel to said electrical current path, and terminates in an area outside and away from said electrical current path.

3. The resistor according to claim 2 wherein said kerf reflexes substantially perpencidular to and away from said current path following said reflex substantially parallel to said current path.

4. A resistor according to claim 3 wherein said kerf terminates on said originating side of said resistor.

5. A resistor according to claim 1 wherein said resistive material is disposed on an insulating substrate.

6. In a method for trimming a film resistor having an electrical current path there accross by forming one or more kerfs in said resistor with a laser beam, the improvement comprising forming the kerf by starting the kerf at an edge of the film resistor and terminating said laser kerf in an area outside and away from said electrical current path.

* * * * *